US007373862B2

(12) United States Patent
Tyler

(10) Patent No.: US 7,373,862 B2
(45) Date of Patent: May 20, 2008

(54) CLAMP DEVICE

(75) Inventor: Terence P. Tyler, Strong, ME (US)

(73) Assignee: Maine Land Research & Development, Inc., Skowhegan, ME (US)

( * ) Notice: Subject to any disclaimer, the term of this patent is extended or adjusted under 35 U.S.C. 154(b) by 0 days.

(21) Appl. No.: 11/447,752

(22) Filed: Jun. 6, 2006

(65) Prior Publication Data

US 2007/0051214 A1 Mar. 8, 2007

Related U.S. Application Data

(63) Continuation-in-part of application No. 11/284,952, filed on Nov. 22, 2005.

(60) Provisional application No. 60/714,030, filed on Sep. 2, 2005.

(51) Int. Cl.
*B25B 13/58* (2006.01)
*B25B 7/02* (2006.01)
*B25B 7/12* (2006.01)

(52) U.S. Cl. ..... 81/367; 81/423

(58) Field of Classification Search ..... 81/367, 81/421–424, 186, 185.1; 269/6, 258
See application file for complete search history.

(56) References Cited

U.S. PATENT DOCUMENTS 1,427,550 A * 8/1922 Ridings ..... 81/423
1,428,679 A * 9/1922 Caswell ..... 294/118
1,750,817 A * 3/1930 Root ..... 81/415
2,173,215 A * 9/1939 Shover ..... 81/423
2,474,940 A * 7/1949 Hansen ..... 29/283
3,061,357 A * 10/1962 Wright ..... 294/106
3,269,766 A * 8/1966 Gardner ..... 294/101
3,383,963 A * 5/1968 Vondrachek ..... 81/423
3,779,108 A 12/1973 Reiter
3,984,092 A * 10/1976 Fitzpatrick ..... 269/88
4,133,519 A 1/1979 Shin et al.
4,583,671 A * 4/1986 Cressy ..... 227/144
4,896,661 A 1/1990 Bogert et al.
5,022,291 A * 6/1991 McBain ..... 81/424
5,113,727 A * 5/1992 Foster ..... 81/423
5,143,359 A * 9/1992 Bush ..... 269/6
5,285,703 A * 2/1994 Carson ..... 81/423
5,791,210 A 8/1998 Wolff et al.
5,992,273 A 11/1999 Galea
6,029,964 A * 2/2000 Bohl ..... 269/6
6,134,993 A 10/2000 Tally
6,199,458 B1 3/2001 Wrigley et al.
6,240,815 B1 * 6/2001 Huang ..... 81/328
6,290,219 B1 9/2001 Barbosa
6,308,597 B1 10/2001 Stahle
6,389,936 B1 5/2002 Domenge
6,401,578 B1 6/2002 Domenge (Continued)

*Primary Examiner*—David B Thomas
(74) *Attorney, Agent, or Firm*—Anthony D. Pellegrini, Esq.

(57) ABSTRACT

An improved clamp device having interchangeable quick release clamping members, said clamping members being moveable relative to the jaws of the device and being magnetic so as to retain the clamp device to a ferro-metallic work piece. The improvements allow increased flexibility of the device over traditionally configured clamps with regard to use of the device with difficult work pieces and environments. The interchangeable clamping members allow a single device to be used for multiple applications, thereby making the invention a low cost and convenient alternative to multiple special purpose tools, as well as permitting quick and inexpensive replacement of wear elements.

20 Claims, 6 Drawing Sheets

U.S. PATENT DOCUMENTS

| | | | | |
|---|---|---|---|---|
| 6,408,724 | B1 | 6/2002 | Whiteford | |
| 6,477,925 | B2 * | 11/2002 | Lin | 81/423 |
| 6,574,845 | B2 * | 6/2003 | Kang | 29/227 |
| 6,601,479 | B1 | 8/2003 | Kramer | |
| 6,708,966 | B1 | 3/2004 | Troudt | |
| 6,748,830 | B1 | 6/2004 | Swanstrom, Jr. | |
| 6,860,179 | B2 | 3/2005 | Hopper et al. | |
| 7,104,166 | B1 * | 9/2006 | Wong | 81/423 |
| 2002/0157507 | A1 | 10/2002 | Chou | |
| 2003/0015072 | A1 | 1/2003 | Chou | |

* cited by examiner

CLAMP DEVICE

CROSS REFERENCE TO RELATED APPLICATION

This application is a continuation in part of U.S. Ser. No. 11/284,952, filed Nov. 22, 2005 and currently pending, entitled Locking Clamp Device, by Tyler, Terence P., which is hereby incorporated by reference. This application further claims priority to a provisional application, U.S. Ser. No. 60/714,030, filed Sep. 2, 2005, entitled Locking Clamp Device, by Tyler, Terence P., which is hereby incorporated by reference, and

BACKGROUND OF THE INVENTION

1. Technical Field

The invention relates generally to the field of hand tools. More specifically, the invention is directed to an improved magnetic clamp device suitable for use with difficult work pieces and environments.

2. Description of Prior Art

Clamps are well-known in the art. Vise-Grip™ brand locking pliers are an example. Such clamps include a handle mechanism, a clamping mechanism manipulated by the handle mechanism, and a locking mechanism suitable for retaining the clamping mechanism in a fixed position relative to a work piece. There many different known methods for implementing these basic structures, for which myriad patents have been issued. The great majority of these prior patents involve various improvements or modifications to the locking mechanisms. Others disclose locking pliers with internal springs to provide tension and a thumb catch for locking/unlocking the tool. Other patents disclose mechanisms for adjusting the angle of the jaws of the clamping mechanisms to accommodate different sizes of work pieces to be gripped. Yet other patents involve tools having jaws which move in relation to the handle mechanisms.

None of the disclosed prior art offers all of the functionality disclosed in the present invention. Moreover, the implementation of similar individual concepts in earlier patents differs significantly with the implementation of the present invention. Thus none of the disclosed prior art anticipates the present invention.

It is an objective of the present invention to provide a useful, improved clamp device with quick release interchangeable clamping members.

It is a further objective of the present invention to provide a useful, improved clamp device with clamping members moveable relative to the jaws to better accommodate work pieces.

It is a further objective of the present invention to provide a useful, improved clamp device with a magnetic clamping member to hold the device onto a ferro-metallic work piece.

It is a further objective of the present invention to provide a useful, improved clamp device with variously shaped clamping members suitable for use with difficutly situated work pieces.

Other objectives of the present invention will be readily apparent from the description that follows.

SUMMARY OF THE INVENTION

The preferred embodiment of the present invention is an improved clamp device having a handle assembly, suitably adapted to be held and manipulated by a human hand; a clamping assembly having a first jaw portion and a second jaw portion; a first clamping member removably attached to the first jaw portion and optionally a second clamping member removably attached to the second jaw portion, with the clamping members suitably adapted to engage with a work piece. In this embodiment the clamping members may pivot or swivel relative to a corresponding jaw portion, to provide greater flexibility in gripping difficultly shaped work pieces. At least one clamping member is magnetic to hold the device onto a ferro-metallic work piece. The clamping members also are configurable in any number of shapes, textures, and hardness.

Other features and advantages of the invention are described below

DETAILED DESCRIPTION OF THE INVENTION

The present invention is directed to an improved clamp device 1.

Figure 1:
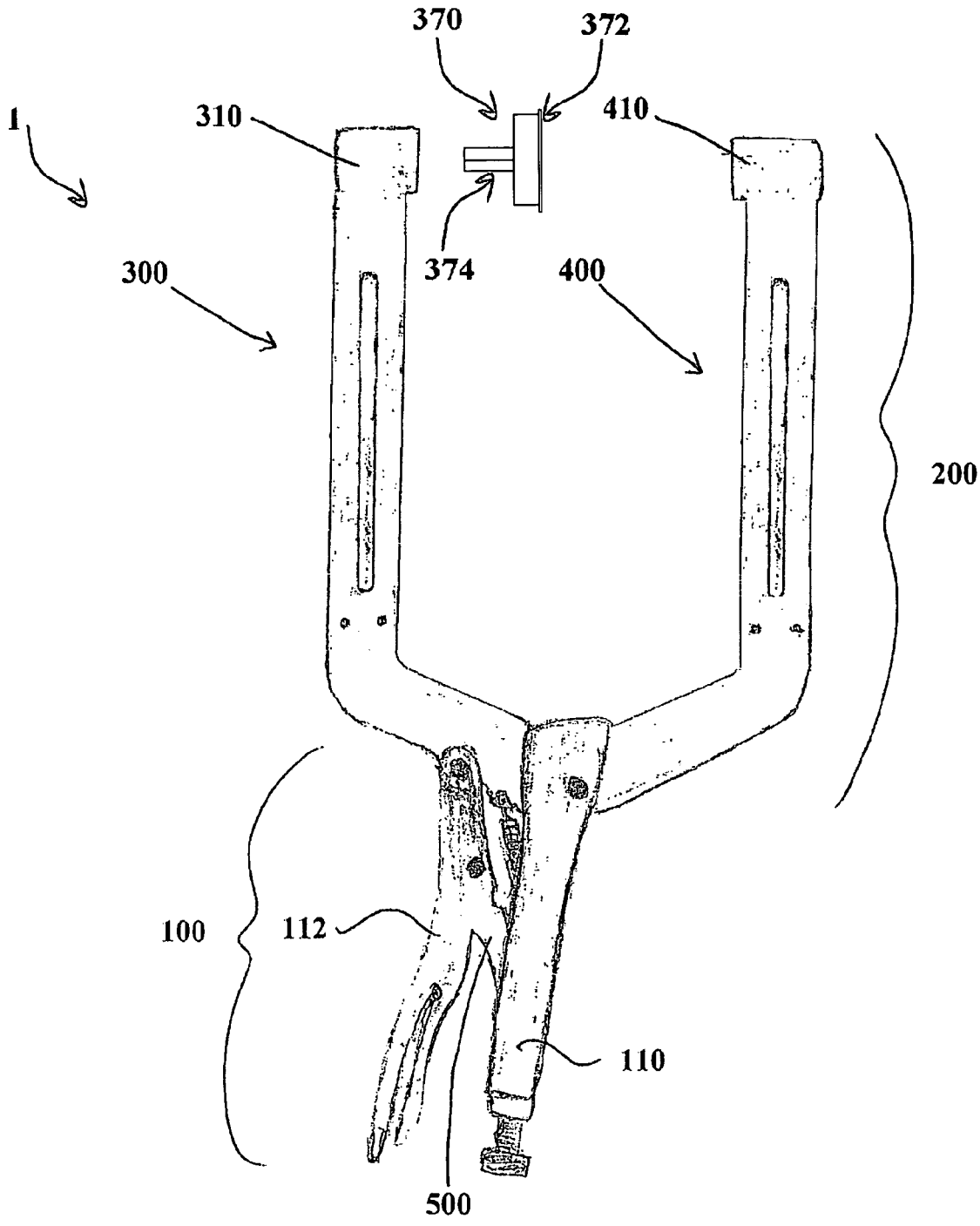
FIG. 1 is a plan view of the clamp device depicting the basic components of the handle assembly, the clamping assembly, and a clamping member.

The clamp device 1 comprises a handle assembly 100 and a clamping assembly 200. See FIG. 1. The handle assembly 100 is held by and manipulated by a human hand in order to actuate the clamping assembly 200 between an opened or a closed position, such that the clamping assembly 200 may sufficiently engage a work piece when in the closed position to hold the work piece securely within the clamp device 1 or to hold the clamp device 1 securely to the work piece, and the clamp device 1 may sufficiently disengage the work piece when in the opened position to permit removal of the work piece from the clamp device 1 or to permit removal of the clamp device 1 from the work piece. The clamp device 1 may also have integrated within the handle assembly 100 a locking means 500 adapted to retain the clamp device 1 in the closed position. The locking means 500 may be any appropriate locking means known in the art suitable for accomplishing the stated function, for example the locking means employed by the Vise-Grip™ brand locking pliers.

The handle assembly 100 has a first handle portion 110 and a second handle portion 112, said handle portions suitably adapted to be held and manipulated by a human hand. The two handle portions are pivotally in connection with each other. The clamping assembly 200 is attached to and integrated with the handle assembly 100. It is comprised of a first jaw portion 300 and a second jaw portion 400. See FIG. 1. Manipulation of the handle assembly 100 causes the jaw portions 300,400 of the clamping assembly 200 to move relative to each other, in that moving the first handle portion 110 towards the second handle portion 112 causes the first jaw portion 300 to move towards the second jaw portion 400, and moving the first handle portion 110 away from the second handle portion 112 causes the first jaw portion 300 to move away from the second jaw portion 400. There are many different configurations for such a handle assembly/clamping assembly combination which embody the above-described characteristics, all well known in the art, and all applicable to the present invention.

The present invention requires that the clamping assembly 200 comprises at least one magnetic clamping member. This enables a ferro-metallic work piece to be engaged by the clamping assembly 200 while the clamping assembly 200 is in the opened position, either to hold the work piece or to attach the clamp 1 to the work piece. This permits accurate placement of the clamp 1 in relation to the work piece prior to setting the clamping assembly 200 to the closed position. When multiple clamps 1 are being used on a ferro-metallic work piece, this allows for whatever readjustments are necessary to optimally position all such clamps 1, before setting them all to the closed position to secure the work piece.

In one embodiment of the present invention, the clamping assembly 200 comprises a first clamping member 370 and a second clamping member 470, with each clamping member 370,470 suitably adapted to engage with a work piece. See FIG. 1. The clamping members 370,470 each have a clamping surface 372,472 suitably adapted to engage with a work piece and an attachment end 374,474 opposite the clamping surface 372,472. The end of each jaw portion 300,400 of the clamping assembly 200 furthest from the handle assembly 100 is designated the clamping end 310,410, and each clamping member 370,470 is removably attached to the clamping end 310,410 of the respective jaw portion 300,400 by an attachment component. The ability to remove the clamping members 370,470 from the jaw portions 300,400 of the clamping assembly 200 allows for the interchangeability of clamping members 370,470 to suit different purposes.

In one variation of this embodiment of the present invention one or both of the clamping members 370,470 pivots relative to its respective clamping end 310,410 of the jaw portions 300,400 of the clamping assembly 200. The pivoting motion is in one direction only, such as up and down or side to side, as may be achieved by use of an axle configuration. The pivoting motion may also be achieved by any other suitable means known in the art.

In another variation of this embodiment of the present invention one or both of the clamping members 370,470 swivels relative to its respective clamping end 310,410 of the jaw portions 300,400 of the clamping assembly 200. The swiveling motion is multi-directional, such as may be achieved by a ball joint 380. The swiveling motion may also be achieved by any other suitable means known in the art. When ball joints 380 are used, the ball joints 380 allow the clamping members 370,470 to swivel relative to their respective clamping ends 310,410 of the jaw portions 300, 400 of the clamping assembly 200 when the clamping assembly 200 is in the opened position, but when the clamping assembly 200 is in the closed position the ball joints 380 lock in place causing the clamping members 370,470 to be stationary relative to their respective clamping ends 310,410 of the jaw portions 300,400 of the clamping assembly 200. This enables the clamp device 1 to be positioned in a multiplicity of directions relative to the work piece when in the closed position for ease of use or to keep the bulk of the tool out of the way. In yet another variation the clamping member 370,470 each comprises a pair of knurls 382 integrated with the ball joint 380 to cause the ball joint 380 to lock in place when the clamping assembly 200 is in the closed position.

Figure 3:
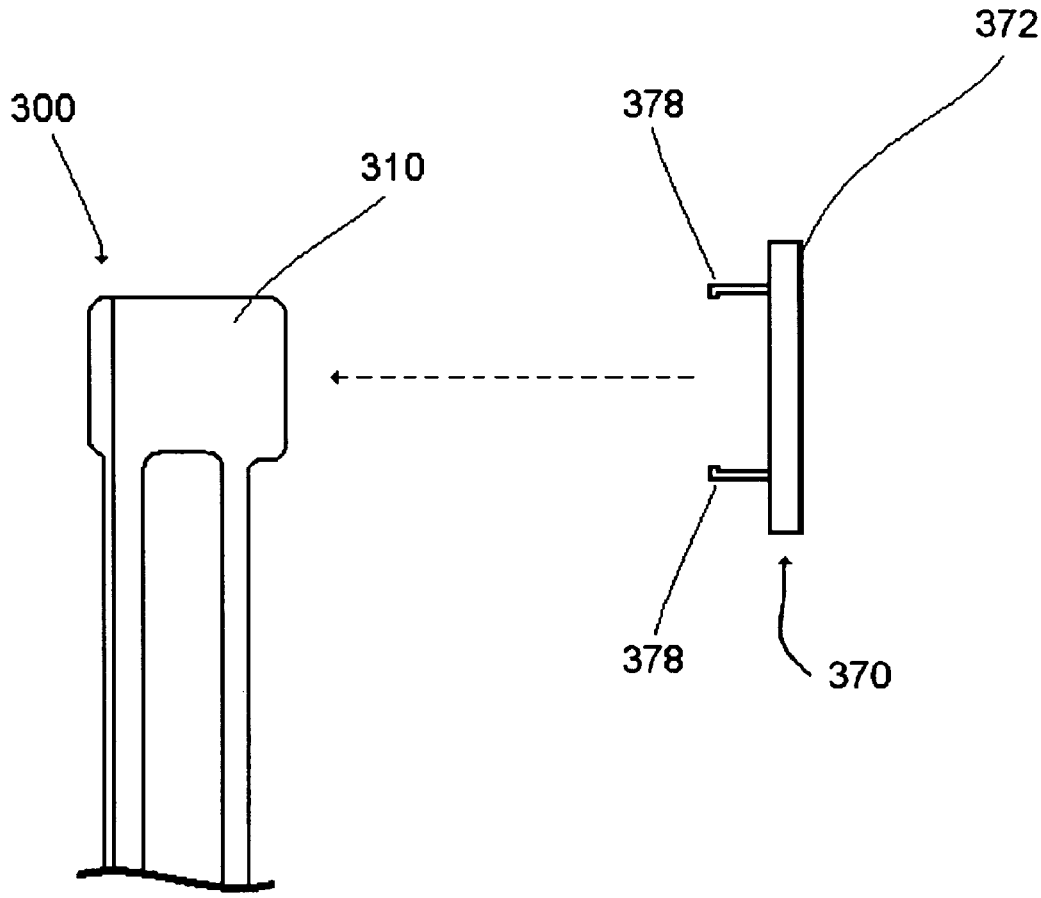
FIG. 3 is a plan view of another embodiment of the first clamping member and the first attachment component.

In the present invention the first attachment component is suitably adapted to function as a "quick release" mechanism to allow for the removal and attachment of clamping members 370,470 quickly and easily without the need to use tools. In one embodiment the attachment end 374 of the first clamping member 370 may comprise lateral flanges 378 suitably adapted to be frictionally secured to the clamping end 310 of the first jaw portion 300 of the clamping assembly 200. See FIG. 3. The attachment component of the second jaw portion 400 and the second clamping member 470 may likewise be similarly configured.

Figure 4:
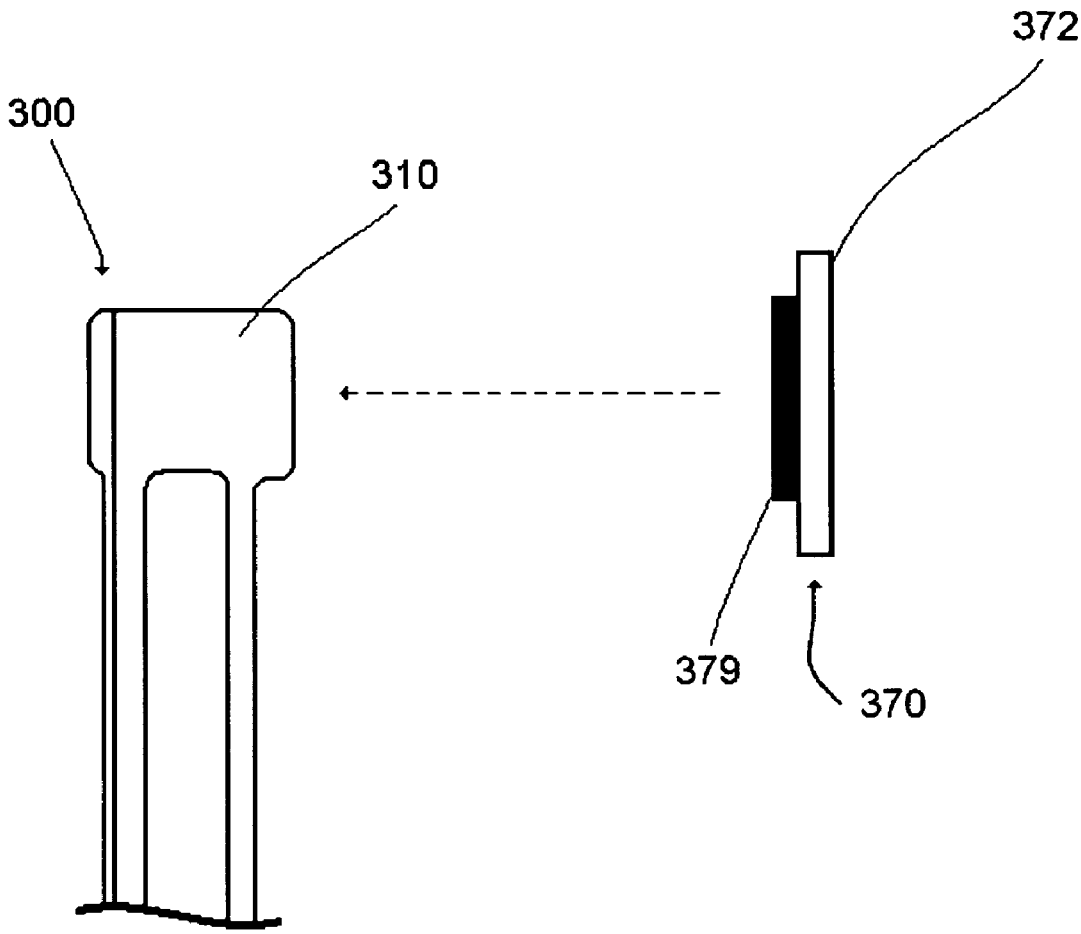
FIG. 4 is a plan view of yet another embodiment of the first clamping member and the first attachment component.

In yet another embodiment of the present invention the attachment end 374 of the first clamping member 370 comprises a rare-earth-element magnet 379. See FIG. 4. The magnet 379 allows the attachment end 374 of the first clamping member 370 to be magnetically secured to the clamping end 310 of the first jaw portion 300 of the clamping assembly 200. In a preferred embodiment the rare-earth-element magnet 379 is a nickel-coated neodymium-iron-boron magnet with an energy product of at least 25 BH. This embodiment is employed only where the clamping end 310 of the first jaw portion 300 of the clamping assembly 200 is ferro-metallic and attractive to a magnet 379.

Figure 2:
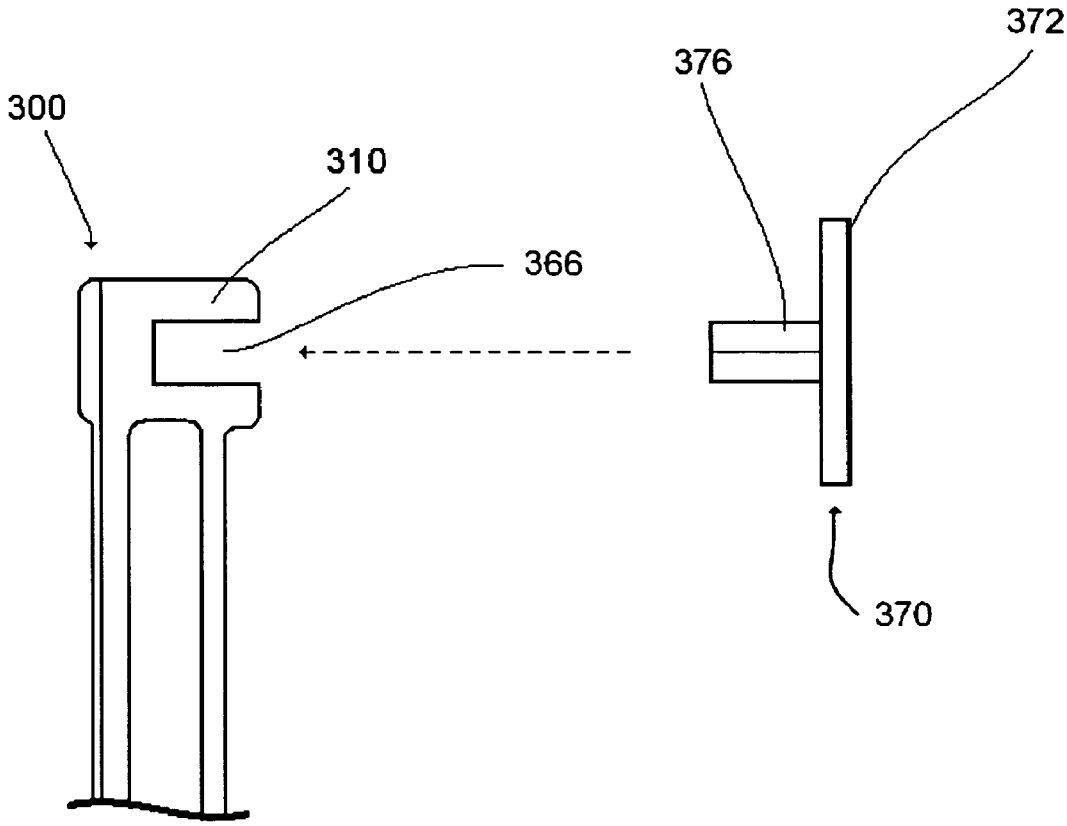
FIG. 2 is a plan view of one embodiment of the first clamping member and the first attachment component, with the clamping ends of the clamp device cut away to show detail.

In the most preferred embodiment of the present invention the first attachment component comprises an inner cavity 366 formed into the clamping end 310 of the first jaw portion 300 of the clamping assembly 200. The attachment end 374 of the first clamping member 370 is inserted into the inner cavity 366 of the clamping end 310 of the first jaw portion 300. In one embodiment the attachment end 374 of the first clamping member 370 has a shaft 376 having substantially hexagonal sides, and the inner cavity 366 of the first attachment component is also substantially hexagonal and just slightly larger than the shaft 376 of the attachment end 374 of the first clamping member 370, such that the shaft 376 of the attachment end 374 of the first clamping member 370 may be snugly accommodated within the inner cavity 366 of the first attachment component. See FIG. 2. Other elements known in the art, such as ball detents, o-rings, and the like, may be integrated into the attachment end 374 of the first clamping member 370 to improve the security of the attachment while preserving the quick release functionality of the invention. The attachment component of the second jaw portion 400 and the second clamping member 470 may likewise be similarly configured.

In another embodiment of the present invention the first clamping member 370 is magnetic and is suitably adapted to attach to a ferro-metallic work piece. This is particularly useful in that when the clamping assembly 200 is in the opened position the work piece can be placed onto and held secure by the first clamping member 370, or alternatively the clamp device 1 can be securely held to the work piece. This allows the work piece or clamp device 1 to be arranged correctly prior to clamping. Where multiple clamp devices 1 are being used on a single work piece, each can be correctly arranged prior to clamping, then all clamped simultaneously once the correct positioning of all has been achieved. An example of this use in is the auto body repair field, where a body panel that is to be bonded to another body panel must be quickly positioned after application of an adhesive; by magnetically attaching multiple clamp devices 1 set in their open positions in the correct orientations on the first body panel in advance, the second body panel can be quickly clamped in the correct orientation immediately after application of the adhesive. In this embodiment the first clamping member 370 may comprise a rare-earth-element magnet. In another embodiment the rare-earth-element magnet should have holding power to support a load of at least one hundred fifty percent (150%) of the weight of the clamp device 1. In yet another embodiment the rare-earth-element magnet is a nickel-coated neodymium-iron-boron magnet with an energy product of at least 25 BH.

Figure 5:
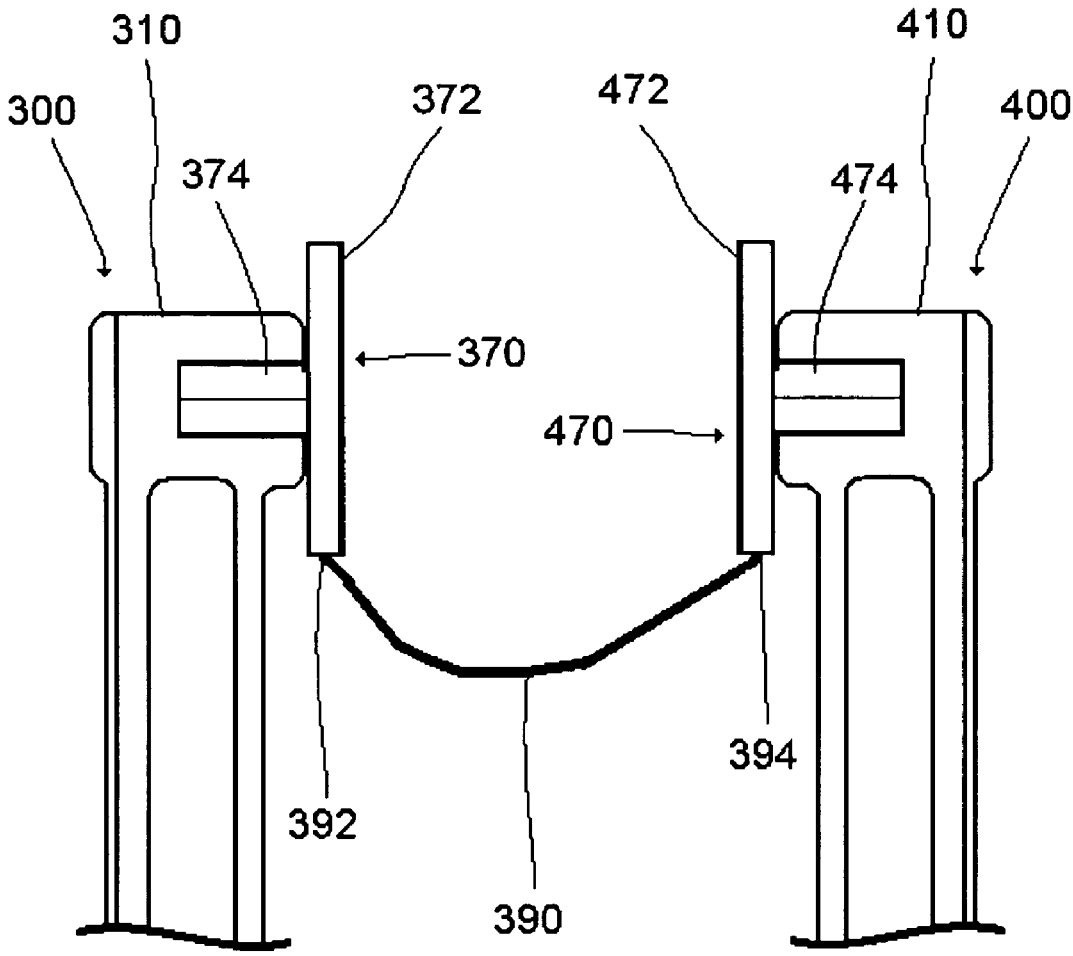
FIG. 5 is a plan view of the conductor embodiment of the present invention, with the clamping ends of the clamp device cut away to show detail.
Figure 6A:
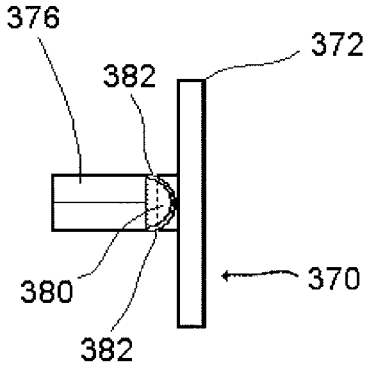
FIG. 6A is a plan view of a clamping member employing a ball joint with a pair of integrated knurls, with a portion of the ball joint cut away to show detail.
Figure 6B:
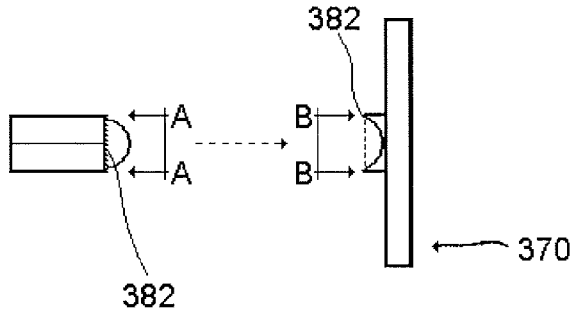
FIG. 6B is an exploded plan view of the clamping member employing a ball joint with a pair of integrated knurls depicted in FIG. 6A.
Figure 6C:
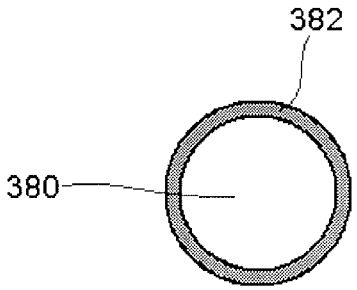
FIG. 6C is a plan view of the ball of the ball joint along line A-A.
Figure 6D:
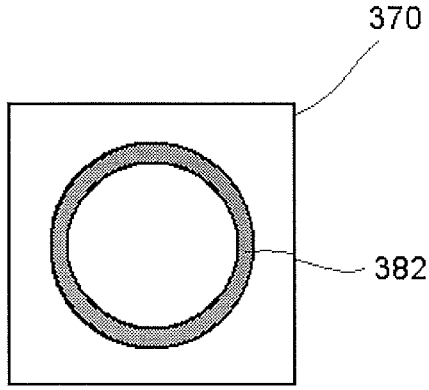
FIG. 6D is a plan view of the socket of the ball joint along line B-B.

In yet another embodiment of the present invention the clamping assembly 200 comprises both a first clamping member 370 and a second clamping member 470. Both clamping members 370,470 are removably attached to the clamping ends 310,410 of the respective jaw portions 300, 400 by attachment components. In this embodiment the clamping members 370,470 further comprise a conductor 390 connecting the clamping members 370,470. See FIG. 5. The conductor 390 is formed of a length of flexible material suitably adapted to conduct an electrical charge. The first end 392 of the conductor 390 is attached to the first clamping member 370 and the second end 394 of the conductor 390 is attached to the second clamping member 470. The conductor 390 must be of sufficient length so that when the clamping assembly 200 is in the fully opened position (where the clamping members 370,470 are furthest apart from each other) the conductor 390 retains a degree of slackness. This embodiment is useful for performing compression spot welds, where the two pieces of metal to be welded have disposed between them a nonconducting material, such as a laminate. This is typical in the auto body industry. The conductor 390 allows the device 1 to clamp together the two pieces of metal to be welded, and further establishes a ground to permit proper compression welding under the described conditions. In the preferred embodiment the conductor 390 is an insulated wire.

The clamping members 370,470 in this embodiment may have clamping surfaces 372,472 of various hardnesses, textures, and shapes. The clamping surfaces 372,472 may be made of a hard, inflexible material, such as tempered steel, or a soft, flexible material, such as a polymer plastic. The clamping surfaces 372,472 may be magnetic. The clamping surfaces 372,472 may be substantially planar. The clamping surfaces 372,472 may be substantially concave. The clamping surfaces 372,472 may be substantially convex. The clamping surfaces 372,472 may be irregularly shaped. The clamping surfaces 372,472 may be constructed of a non-stick compound to better enable the device 1 to be used with adhesives. The two clamping members 370,470 need not have clamping surfaces 372,472 with the same hardness, texture, or shape.

The clamping members 372,472 may further comprise removable clamping surfaces 372,472, whereby the clamping surfaces 372,472 may be clipped on and off the clamping members 370,470. This embodiment permits reusable clamping surfaces 372,472 for applications where they are prone to damage or wear. In one embodiment the removable clamping surface 372 comprises lateral flanges suitably adapted to be frictionally secured to the first clamping member 370. Other methods for securing the clamping surface 372 to the first clamping member 370 are also contemplated, such as by the use of an adhesive, a set screw, or a magnet. The ability to interchange clamping members 370,470 having various hardnesses, textures, and shapes allows the clamp device 1 to be used in a wide range of applications. One such application is for automobile body work, where the various body panels of the automobile have different shapes. Clamping members 370,470 may be designed to fit specific body panels from various automobile manufacturers so that the panels may be held securely and without damage.

The potentially unlimited range of shapes, textures, and hardnesses of the clamping surfaces 372,472 of the clamping members 370,470 provides virtually unlimited uses for the present invention.

In an alternative embodiment of the present invention, the user may be assisted in manipulating the handle assembly 100 by the inclusion of an electro-mechanical or pneumatic device integrated with the handle assembly 100. Such devices are well-known in the art and are frequently integrated with hand tools used in the automobile repair industry.

Modifications and variations can be made to the disclosed embodiments of the invention without departing from the subject or spirit of the invention.

I claim:

1. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

wherein the first clamping member comprises a ball joint which allows the first clamping member to swivel in multiple directions relative to the clamping end of the first jaw portion of the clamping assembly when the clamping assembly is in the opened position, and the first clamping member comprises a pair of knurls integrated with the ball joint to cause the ball joint to lock in place when the clamping assembly is in the closed position, such that the first clamping member remains stationary relative to the clamping end of the first jaw portion of the clamping assembly when the clamping assembly is in the closed position;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

2. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

wherein the first clamping member has a clamping surface suitably adapted to engage with a work piece and an attachment end opposite the clamping surface of the first clamping member; and the first attachment component comprises an inner cavity formed into the clamping end of the first jaw portion of the clamping assembly, and the attachment end of the first clamping member;

whereby the attachment end of the first clamping member is suitably adapted to be inserted into the inner cavity of the first attachment component, the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

3. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member having a clamping surface suitably adapted to engage with a work piece and an attachment end opposite the clamping surface of the first clamping member; with said first attachment component comprising an inner cavity formed into the clamping end of the first jaw portion of the clamping assembly, and the attachment end of the first clamping member;

wherein the attachment end of the first clamping member has a shaft, with said shaft having substantially hexagonal sides, and the inner cavity of the first attachment component having a suitable shape and dimension to frictionally accommodate the shaft of the attachment end of the first clamping member;

whereby the attachment end of the first clamping member is suitably adapted to be inserted into the inner cavity of the first attachment component, the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

4. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

wherein the first clamping member has a clamping surface suitably adapted to engage with a work piece and an attachment end opposite the clamping surface of the first clamping member, said attachment end comprising a rare-earth-element magnet suitably adapted to be magnetically secured to the clamping end of the first jaw portion of the clamping assembly; and the first attachment component comprises the attachment end of the first clamping member;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

5. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

wherein the first clamping member is magnetic and is suitably adapted to securely hold a ferro-metallic work piece when the clamping assembly is in the opened position or to securely hold the clamp device to the ferro-metallic work piece when the clamping assembly is in the opened position;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

6. The clamp device of claim 5, wherein the first clamping member includes a rare-earth-element magnet.

7. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, a first clamping member, said first clamping member removably attached to the clamping end of the first jaw portion by a first attachment component, with said first clamping member suitably adapted to engage with a work piece, a second clamping member, said second clamping member removably attached to the clamping end of the second jaw portion by a second attachment component, with said second clamping member suitably adapted to engage with a work piece, and a conductor, said conductor formed of a length of flexible material suitably adapted to conduct an electrical charge, said conductor having a first end and a second end, wherein the first end of the conductor is attached to the first clamping member and the second end of the conductor is attached to the second clamping member;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

8. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

a second clamping member, said second clamping member removably attached to the clamping end of the second jaw portion by a second attachment component, with said second clamping member suitably adapted to engage with a work piece; and a conductor, said conductor formed of a length of flexible material suitably adapted to conduct an electrical charge, said conductor having a first end and a second end;

wherein the first end of the conductor is attached to the first clamping member and the second end of the conductor is attached to the second clamping member and the conductor comprises an insulated wire;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

9. A clamp device, comprising a handle assembly, having a first handle portion and a second handle portion, said handle portions suitably adapted to be held and manipulated by a human hand; and a clamping assembly attached to and actuated by the handle assembly to an opened position or a closed position, said clamping assembly having a first jaw portion having a clamping end distal to the handle assembly, a second jaw portion having a clamping end distal to the handle assembly, and a first clamping member, said first clamping member removably attached to the clamping end of the first jaw portion by a first attachment component, with said first clamping member suitably adapted to engage with a work piece;

wherein the first clamping member comprises a clamping surface suitably adapted to engage with a work piece, said clamping surface suitably adapted to be removably attached to the first clamping member;

whereby the closed position of the clamping assembly comprises a relative orientation of the first clamping member with the clamping end of the second jaw portion in which said clamping member and clamping end of the second jaw portion are sufficiently engaged with a work piece to hold the work piece securely within the clamp device or to hold the clamp device securely to the work piece, and the opened position of the clamping assembly comprises a relative orientation of the first clamping member with the clamping end of the second jaw portion in which said clamping member and clamping end of the second jaw portion are sufficiently disengaged from a work piece to permit removal of the work piece from the clamp device or to permit removal of the clamp device from the work piece.

10. The clamp device of claim 9, wherein the clamping surface comprises lateral flanges suitably adapted to be frictionally secured to the first clamping member.

11. The clamp device of claim 9, wherein the clamping surface comprises a rare-earth-element magnet.

12. A clamping member for use with a clamp device, said clamping member suitably adapted to engage with a work piece and comprising a clamping surface suitably adapted to engage with a work piece; and an attachment end opposite the clamping surface suitably adapted to be removably attached to the clamp device;

said clamping member further comprising a ball joint, wherein said ball joint allows the clamping member to swivel in multiple directions relative to the clamp device when the clamping assembly is in an opened position, and the ball joint locks in place causing the clamping member to be stationary relative to the clamp device when the clamp device assembly is in a closed position.

13. A clamping member for use with a clamp device, said clamping member suitably adapted to engage with a work piece and to swivel in multiple directions relative to the clamp device, comprising a clamping surface suitably adapted to engage with a work piece;

an attachment end opposite the clamping surface suitably adapted to be removably attached to the clamp device;

a ball joint, wherein said ball joint allows the clamping member to swivel relative to the clamp device when the clamping assembly is in an opened position, and the ball joint locks in place causing the clamping member to be stationary relative to the clamp device when the clamp device assembly is in a closed position; and a pair of knurls integrated with the ball joint to cause the ball joint to lock in place when the clamp device is in the closed position.

14. A clamping member for use with a clamp device, said clamping member suitably adapted to engage with a work piece and comprising a clamping surface suitably adapted to engage with a work piece; and an attachment end opposite the clamping surface suitably adapted to be removably attached to the clamp device;

wherein the attachment end comprises a shaft.

15. A clamping member for use with a clamp device, said clamping member suitably adapted to engage with a work piece and comprising a clamping surface suitably adapted to engage with a work piece; and an attachment end opposite the clamping surface suitably adapted to be removably attached to the clamp device;

wherein the attachment end comprises a rare-earth-element magnet suitably adapted to magnetically secure the clamping member to the clamp device.

16. A clamping member for use with a clamp device, said clamping member suitably adapted to engage with a work piece and comprising a clamping surface suitably adapted to engage with a work piece; and an attachment end opposite the clamping surface suitably adapted to be removably attached to the clamp device;

wherein the clamping surface is magnetic and is suitably adapted to securely hold a ferro-metallic work piece when the clamp device is in an opened position or to securely hold the clamp device to the ferro-metallic work piece when the clamp device is in the opened position.

17. The clamping member of claim 16, wherein the clamping surface comprises a rare-earth-element magnet.

18. A clamping member for use with a clamp device, said clamping member suitably adapted to engage with a work piece and comprising a clamping surface suitably adapted to engage with a work piece, said clamping surface suitably adapted to be removably attached to the clamping member; and an attachment end opposite the clamping surface suitably adapted to be removably attached to the clamp device.

19. A pair of clamping members for use with a clamp device, each said clamping member suitably adapted to engage with a work piece and comprising a clamping surface suitably adapted to engage with a work piece, and an attachment end opposite the clamping surface suitably adapted to be removably attached to the clamp device; and a conductor, said conductor formed of a length of flexible material suitably adapted to conduct an electrical charge, said conductor having a first end and a second end, wherein the first end of the conductor is attached to one of the clamping members and the second end of the conductor is attached to the other of the clamping members.

20. A pair of clamping members for use with a clamp device, each said clamping member suitably adapted to engage with a work piece and comprising a clamping surface suitably adapted to engage with a work piece, and an attachment end opposite the clamping surface suitably adapted to be removably attached to the clamp device; and a conductor, said conductor formed of a length of flexible material suitably adapted to conduct an electrical charge, said conductor having a first end and a second end, wherein the first end of the conductor is attached to one of the clamping members and the second end of the conductor is attached to the other of the clamping members; and the conductor comprises an insulated wire.

* * * * *